7/1/86 XR 4,597,456

United States Patent [19]

Ecer

[11] Patent Number: 4,597,456

[45] Date of Patent: Jul. 1, 1986

[54] CONICAL CUTTERS FOR DRILL BITS, AND PROCESSES TO PRODUCE SAME

[75] Inventor: Gunes M. Ecer, Irvine, Calif.

[73] Assignee: CDP, Ltd., Newport Beach, Calif.

[21] Appl. No.: 633,635

[22] Filed: Jul. 23, 1984

[51] Int. Cl.[4] ..... E21B 10/08

[52] U.S. Cl. ..... 175/371; 175/410; 76/108 A; 384/95

[58] Field of Search ..... 175/371, 372, 374, 375, 175/409, 410; 76/108 R, 108 A; 29/149.5 PM; 384/92, 95; 308/DIG. 8

[56] References Cited

U.S. PATENT DOCUMENTS

| | | | |
|---|---|---|---|
| 2,833,520 | 5/1958 | Owen | 175/409 X |
| 3,235,316 | 2/1966 | Whanger | 384/95 |
| 3,310,870 | 3/1967 | Parikh et al. | 29/420.5 |
| 3,453,849 | 7/1969 | Clarke et al. | 72/46 |
| 3,721,307 | 3/1973 | Mayo | 175/372 |
| 3,800,891 | 4/1974 | White et al. | 175/374 |
| 3,823,030 | 7/1974 | Hudson | 175/372 X |
| 3,984,158 | 10/1976 | Sorensen et al. | 384/93 |
| 3,995,917 | 12/1976 | Quinlan | 384/95 |
| 4,074,922 | 2/1978 | Murdoch | 384/93 |
| 4,108,692 | 8/1978 | Quinlan | 175/374 X |
| 4,173,457 | 11/1979 | Smith | 175/409 X |
| 4,365,679 | 12/1982 | van Nederveen et al. | 175/371 |
| 4,368,788 | 1/1983 | Drake | 175/374 |
| 4,396,077 | 8/1983 | Radtke | 76/108 A X |
| 4,484,644 | 11/1984 | Cook et al. | 175/409 X |
| 4,520,882 | 6/1985 | van Nederveen | 175/410 |

*Primary Examiner*—Stuart S. Levy
*Assistant Examiner*—David Werner
*Attorney, Agent, or Firm*—William W. Haefliger

[57] ABSTRACT

A roller bit cutter comprises:

(a) a tough, metallic generally conical and fracture resistant core having a hollow interior, the core defining an axis, (b) an annular metallic radial bearing layer carried by said core at the interior thereof to support the core for rotation, said bearing layer extending about said axis, (c) an impact and wear resistant metallic inner layer on the core, at the interior thereof, to provide an axial thrust bearing, and (d) hard metallic inserts having anchor portions carried by the core and partly embedded therein, the inserts protruding outwardly at the exterior of the core to define cutters, at least some of the inserts spaced about said axis, (e) and a wear resistant outer metallic layer on the exterior of said core.

27 Claims, 16 Drawing Figures

EVERY CONTINUOUS ARROW PATH FROM STEP 1 TO STEP Nº 15 (SEE TABLE 1) REPRESENTS A MANUFACTURING PROCESS

CONICAL CUTTERS FOR DRILL BITS, AND PROCESSES TO PRODUCE SAME

A roller bit cutter comprises:

(a) a tough, metallic generally conical and fracture resistant core having a hollow interior, the core defining an axis, (b) an annular metallic radial bearing layer carried by said core at the interior thereof to support the core for rotation, said bearing layer extending about said axis, (c) an impact and wear resistant metallic inner layer on the core, at the interior thereof, to provide an axial thrust bearing, and (d) hard metallic inserts having anchor portions carried by the core and partly embedded therein, the inserts protruding outwardly at the exterior of the core to define cutters, at least some of the inserts spaced about said axis, (e) and a wear resistant outer metallic layer on the exterior of said core.

BACKGROUND OF THE INVENTION

This invention relates generally to conical cutters (usually called cones) used in roller bits employed in oil-well drilling and in drilling of holes for mining purposes. The invention further concerns a process through which the conical cutters may be most conveniently manufactured as integrated composite structures, and secondly, novel cutters and cutter component structures as well as composition thereof provide important properties associated with localized sections of the cutters.

Conical cutters must operate under severe environmental conditions and withstand a variety of "bit-life" reducing interactions with the immediate surroundings. These include abrasive or erosive actions of the rock being drilled, impact, compressive and vibrational forces that result from rotation of the bit under the weight put on the bit, and the sliding wear and impact actions of the journal pin around which the cone is rotating. The severity, as well as the variety of life-reducing forces acting upon conical cutters, dictate that these cutters not be made of a simple material of uniform properties if they are to provide a cost-effective, down-hole service life. Instead, localized properties of cone sections should withstand the localized forces acting on those sections.

Conventional cones utilizing tungsten carbide inserts (TCI) are commonly manufactured from a forged shape. Holes are drilled circumferentially around the forged cutter body to receive hard-cutting elements, such as cobalt cemented tungsten carbide inserts or TCI's, which are press-fitted into the holes. TCI shape must, therefore, be the same as the hole shape, and have parallel side surfaces.

The cone body normally requires surface hardening to withstand the erosive/abrasive effect of rock drilling. This may be accomplished by any of the widely used surface modification or coating techniques, such as transformation hardening, carburizing, nitriding, hardfacing, hard metal coating or brazed-on hard metal cladding.

In addition, interior surfaces of the cone are required in certain areas to be hard, wear and impact resistant to accommodate loading from both the thrust and the radial directions (with respect to the journal pin axial direction). Consequently, these surfaces are also hardened by a surface hardening process. On the journal side, the pin surfaces likely to contact "thrust bearing" surfaces are usually hardfaced and run against a hardened cone or a hardened nose button insert in the cone or a carburized tool steel bushing. In most roller cones, a row of uncapped balls run in races between the nose pin and the roller or journal bearing. These balls may carry some thrust loading, but their primary function is to retain the cone on the journal pin when not pressing against the bottom of the hole.

The major load is the radial load and is carried substantially either by a full complement of cylindrical rollers used primarily in mining operations, or a sealed journal bearing used in oil-field drilling. The journal bearings are normally operated with grease lubrication and employ additional support to prolong bearing life; i.e., self-lubricating porous floating rings(1), beryllium-copper alloy bearing coated with a soft metal lubricating film(2,3), a bearing with inlays of soft metal to provide lubrication and heat transfer(4), or an aluminum bronze inlay(5) in the cone as the soft, lubricating member of the journal-cone bearing couple.

DEFICIENCIES IN THE PRIOR ART

The present manufacturing of cones for TCI bits is a tedious and precise art, regardless of the manufacturer. Hole sizes and shapes must be matched with those of the TCI's in order to have a tight fit. The fit must not be too tight for fear of causing damage to either the hole periphery or the insert itself during press-fitting operations. If the fit is less than a threshold tightness, the insert may come loose in drilling and be lost, causing major damage to the bit, and most frequently leading to premature (and costly) pull of the bit out of the hole being drilled. This may occur most readily when drilling soft (rock) formations and is one reason to limit the insert extension to prevent insert pull-out. Limiting insert extension (out of the cone), in turn, may slow the rate of penetration into the formation during drilling and thus has a negative influence on the bit performance.

Cone surfaces, must also be treated to impart the desired localized properties. These treatments are usually long, i.e., carburizing; or inadequate, i.e., hard coatings that are sprayed or electro-deposited, or have side effects that compromise overall properties of the cone; i.e., hardfacing of weld cladding cause heat-affected regions of inferior properties.

In addition, each of the above-mentioned operations require prior preparation, labor expertise and multiple inspections to assure the needed accuracy both in dimensions and materials properties. In short, cone manufacturing, as it is performed presently, is a long, precise and labor-intensive operation.

SUMMARY OF THE INVENTION

It is a major object of the invention to provide manufacturing methods that separate surface hardening or modification treatments for different cone surfaces and replace them with simple, low-temperature painting, slurry dipping or spraying operations. Desired localized properties are obtained by applications of selected powders or shaped inserts rather than by thermal treatments, thus providing a wider selection of property variation for a more precise means of meeting external wear, impact of simple loading requirements.

The subject processes involve near isostatic hot pressing of cold formed powders. See U.S. Pat. Nos. 3,356,496 and 3,689,259. The basic process isostatically hot presses near net shape parts in a matter of a few minutes, producing properties similar to those produced by the conventional Hot Isostatic Pressing (HIP) process without the lengthy thermal cycle required by HIPing.

The resultant roller bit cutter basically comprises:

(a) a tough, metallic generally conical and fracture resistant core having a hollow interior, the core defining an axis, (b) an annular metallic radial bearing layer carried by the core at the interior thereof to support the core for rotation, the bearing layer extending about said axis, (c) an impact and wear resistant metallic inner layer on the core, at the interior thereof, to provide an axial thrust bearing, and (d) hard metallic inserts having anchor portions carried by the core and partly embedded therein, the inserts protruding outwardly at the exterior of the core to define cutters, at least some of the inserts spaced about said axis, (e) and a wear resistant outer metallic layer on the exterior of the core.

Further, and as will be seen, the inserts may consist essentially of tungsten carbide; the core typically defines multiple recesses receiving the insert anchor portions, the outer metallic layer extending into said recesses and between the core and said insert anchor portions; at least one and typically all of the layers consists or consist of consolidated powder metal; the insert anchor portions typically have non-parallel side surfaces, and said outer layer has non-parallel sided portions compressively engaging said insert ends, in the recesses.

In addition, the core typically consists essentially of steel alloyed with elements that include carbon, manganese, silicon, nickel, chromium, molybdenum, and copper, or the core may consist of cast alloy steel, or of ultra high strength steel. The outer layer may consist of a composite mixture of refractory particles in a binder metal such particles typically having micro hardness in excess of 1,000 kg/mm$^2$, and a melting point in excess of 1,600° C. Also, the refractory particles are typically selected from the group consisting of Ti, W, Al, V, Zr, Cr, Mo, Ta, Nb, Hf, and carbides, oxides, nitrides and borides thereof. As, an alternative, the outer layer may consist of tool steel initially in powder form, or of a hardfacing alloy, as will be seen, or of wear resistant, intermetallic Laves phase materials, as will appear.

These and other objects and advantages of the invention, as well as the details of an illustrative embodiment, will be more fully understood from the following specification and drawings, in which:

DRAWING DESCRIPTION

Figure 5A:
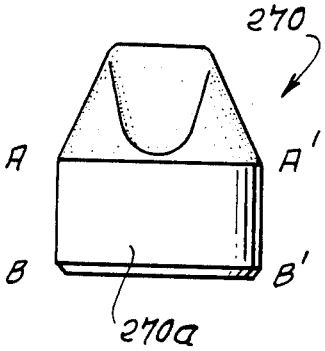
Figure 5B:
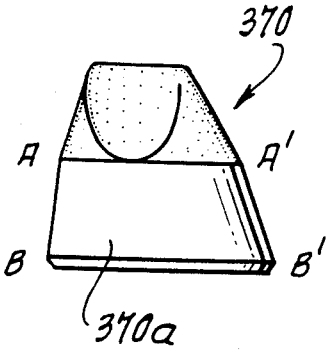
Figure 6A:
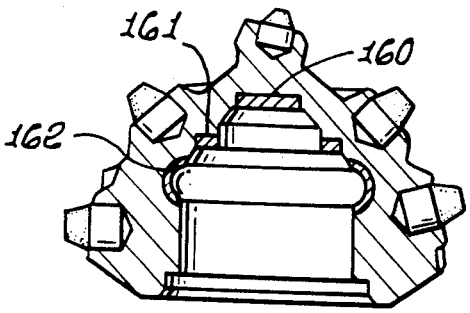
Figure 6B:
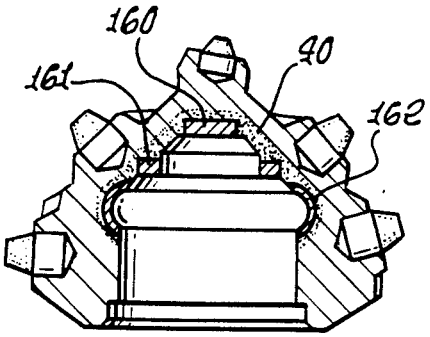

FIGS. 5*a* and 5*b* are elevations showing different forms of inserts; and FIGS. 6*a* and 6*b* are sections showing modified cutter constructions; and FIGS. 7*a*–7*h* show detailed process steps.

DETAILED DESCRIPTION

Figure 1:
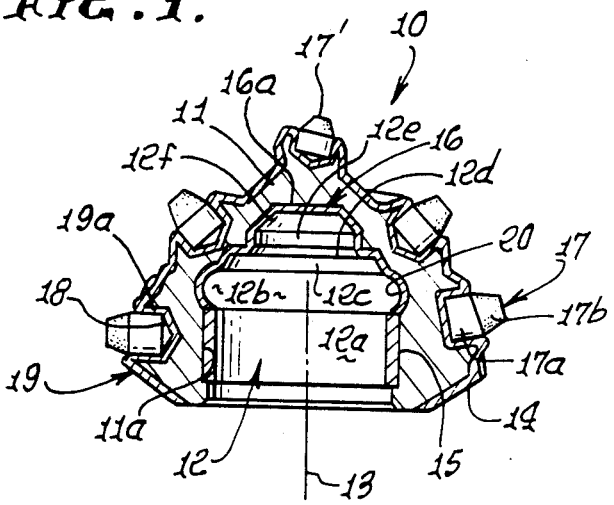
FIG. 1 is an elevation, in section of a conical cutter used in three cone rock bits.

In FIG. 1, the illustrated improved roller bit cutter 10 incorporating the invention includes a tough, metallic, generally conical and fracture resistant core 11. The core has a hollow interior 12, and defines a central axis 13 of rotation. The bottom of the core is tapered at 14, and the interior includes multiple successive zones 12*a*, 12*b*, 12*c*, 12*d*, 12*e* and 12*f*, concentric to axis 13, as shown. An annular metallic radial (sleeve type) bearing layer 15 is carried by the core at interior zone 12*a* to support the core for rotation. Layer 15 is attached to annular surface 11*a* of the core, and extends about axis 13. It consists of a bearing alloy, as will appear.

An impact and wear resistant metallic inner layer 16 is attached to the core at its interior zones 12*b*–12*f*, to provide an axial thrust bearing; as at end surface 16*a*. A plurality of hard metallic inserts 17, as for example of tungsten carbide, have inner anchor portions 17*a* carried by the core to be partly embedded or received in core recesses 18. The inserts also have portions 17*b* that protrude outwardly, as shown, to define cutters (see also FIGS. 4, 5*a* and 5*b*), at least some of the inserts spaced about axis 13. One insert 17' may be located at the extreme outer end of the core, at axis 13.

Finally, a wear resistant outer metallic skin or layer 19 is on and attached to the core exterior surface, to extend completely over that surface including the surfaces of the core portions that define the recesses 18, whereby the inserts are in fact attached to the layer portions 19*a* in those recesses.

Figure 3:
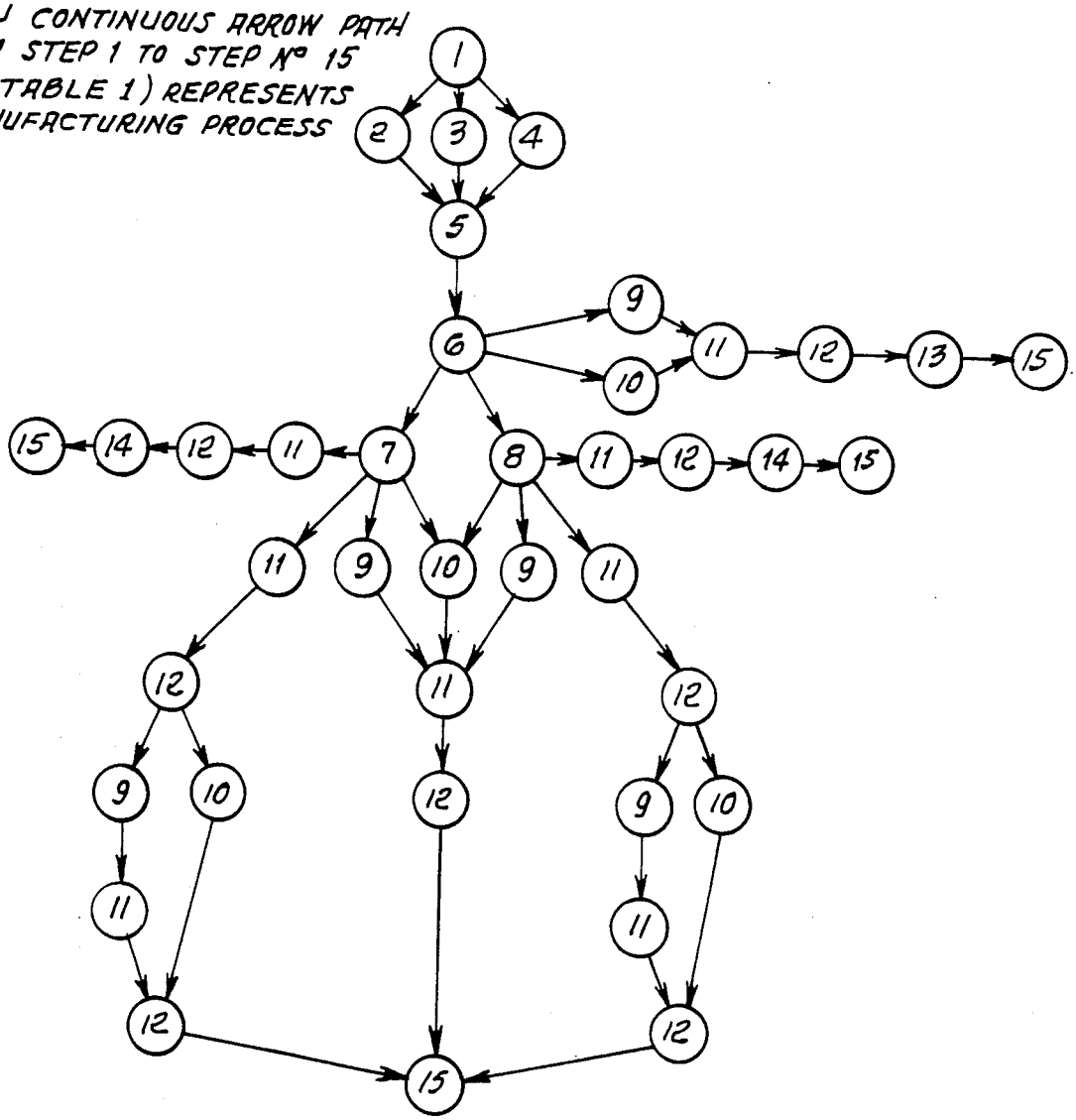
FIG. 3 is a flow diagram showing steps of a manufacturing process for the conical cutter.

In accordance with the invention, at least one or two of the layers 15, 16 and 19 consists essentially of consolidated powder metal, and preferably all three layers consist of such consolidated powder metal. A variety of manufacturing schemes are possible using the herein disclosed hot pressing technique and the alternative means of applying the surface layers indicated in FIG. 1. It is seen from the previous discussion that surface layers 15, 16 and 19 are to have quite different engineering properties than the interior core section 11. Similarly, layers 16 and 19 should be different than 15, and even 16 should differ from 19. Each of these layers and the core piece 11 may, therefore, be manufactured separately or applied in place as powder mixtures prior to cold pressing. Thus, there may be a number of possible processing schemes as indicated by arrows in FIG. 3. The encircled numbers in this figure refer to the possible processing steps (or operations) listed in below Table I. Each continuous path in the figure, starting from Step No. 1 and ending at Step No. 15, defines a separate processing scheme which, when followed, is capable of producing integrally consolidate composite conical cutters.

TABLE I

A list of major processing steps which may be included in the processing:

1. Blend powders
2. Cold press powder to pre-form green interior core piece 11 (see FIG. 1 for location).
3. Cold press and sinter or hot press within a range 1,800° F. to 1,240° F., powder to pre-form, less than fully dense, core piece 11.
4. Forge or cast fully dense core piece 11.

5. Place TCI's in blind end holes or recesses in core piece 11.
6. Apply powdered hard metal compound skin 19; i.e., by painting, slurry dipping or cold spraying a mixture of hard metal powder, a fugitive organic binder and a volatile solvent.
7. Apply thrust-bearing alloy powder layer 16; i.e., by painting, slurry dipping or cold spraying a mixture of thrut-bearing alloy powder, a fugitive organic binder and a volatile solvent.
8. Place wrought, cast or sintered powder metal thrust-bearing piece 16 in the core piece 11.
9. Apply powdered radial bearing alloy 15 in the core piece i.e., by painting, slurry dipping or cold spraying a mixture of bearing alloy powder, a fugitive organic binder and a volatile solvent.
10. Place wrought, cast or sintered powder metal radial bearing alloy 15 in the core piece.
11. Dry or bake to remove binder from powder layers 19, 16 or 15. Drying temperatures may be typically 60°-300° F., preferably in a neutral or a reducing atmosphere except when dried at or near room temperature.
12. Hot press to consolidate the composite into a fully dense (99+% of theoretical density) conical cutter. Typically, the hot pressing may be carried out at 2100° F.±200° and under pressure of 20–50 tons per square inch.
13. Weld deposit thrust-bearing alloy at desired locations of layer 16 in the densified cone.
14. Weld deposit radial-bearing alloy 15 in the densified cone.
15. Final finish; i.e., grind or machine ID profile, finish grind bearings, finish machine seal seat, inspect, etc.

The processing schemes outlined, include only the major steps involve in the flow of processing operations. Other secondary operations that are routinely used in most processing schemes for similarly manufactured products, are not included for sake of simplicity. These may be cleaning, manual patchwork to repair small defects, grit blasting to remove loose particles or oxide scale, dimensional or structural inspections, etc.

All of the processing steps are unique, as may easily be recognized by those who are familiar with the metallurgical arts in the powder metals processing field. Each provides a number of benefits from the processing point of view, and some of which are listed as follows:

(1) All assembly operations; i.e., painting, spraying, placing, etc. in preparing the composite cutter structure for the hot-pressing operation (Step No. 12 in Table I) are performed at or near room temperature. Thus, problems associated with thermal property differences or low strength, unconsolidated state of the composite cone prior to hot densification, are avoided. Repair work, geometrical or dimensional control, and in-process handling are greatly simplified.

(2) Application of powdered metal or alloy or metal compound surface layers, using volatile binders, such cellulose acetate, corn starch and various distilled products, provide sturdy powder layers strongly held together by the binding agent, thus adding to the green strength of the total unconsolidated cone structure. This makes it easy to control surface layer thickness, handling of the assembly in processing and provides mechanical support for the TCI's.

(3) Low temperature application of afore-mentioned surface layers avoids pitfalls associated with high temperature spraying of powders, as promoted by Nederveen et al (U.S. Pat. No. 4,365,679). As is well known, thermally-sprayed metal powders incorporate oxides into the sprayed layers. Oxide particles in surface layers may act as structural discontinuities or notches, thus weakening the part.

(4) The proposed schemes in every case produce a near-net-shape product, greatly reducing the labor-intensive machining operations required in the conventional conical cutter production.

(5) The consolidation of various components of the cone, after applying them in powder or insert form, allows the use of inserts having non-parallel side surfaces, as illustrated in FIG. **5*b* (see insert 370 with tapered bottom portion 370*a* to be received in a cone recess). This provides, in the finished product, a greatly increased support for each insert, practically eliminating in-service pull-out. In addition, the structual integrity thus provided for the inserts allows insert extensions substantially more than is otherwise. Further benefits in insert wear mode and increased rate of penetration into the rock formation can be achieved with one portion of the insert being longer than the other as shown in FIG. 5*b***, where A'B' is longer than AB.

PROPOSED CONE MATERIAL

Various sections of the cone cross-section have been identified in FIG. 1, each requiring different engineering properties to best function in service. Consequently, materials for each section should be selected separately.

Interior core piece 11 should be made of an alloy possessing high strength and toughness, and preferably requiring thermal treatments below 1700° F. (to reduce damage due to cooling stresses) to impart its desired mechanical properties. Such restrictions can be met by the following classes of materials:

(1) Hardening grades of low-alloy steels (ferrous base) with carbon contents ranging nominally between 0.1 and 0.65%, manganese 0.01 to 2.0%, silicon 0.01 to 2.2%, nickel 0.4 to 3.75%, chromium 0.01 to 1.2%, molybdenum 0.15 to 0.40%, copper to 0.3% and remainder substantially iron, total of all other elements to be less than 1.0% by weight.

(2) Castable alloy steel having less than 8% total alloying element content; most typically ASTM-A148-80 grades.

(3) Ultra-high strength steels most specifically known in the industry as: D-6A, H-11, 9Ni-4Co, 18-Ni maraging, 300-M, 4130, 4330 V, 4340. These steels nominally have the same levels of C, Mn and Si as do the low-alloy steels described in (1) above. However, they have higher contents of other alloying elements: chromium up to 5.0%, nickel to 19.0%, molybdenum to 5.0%, vanadium to 1.0%, cobalt to 8.0%, with remaining substantially iron, and all other elements totalling less than 1.0%.

(4) (Ferrous) powder metal steels with nominal chemistries falling within: 79 to 98% iron, 0–20% copper, 0.4 to 1.0% carbon, and 0–4.0% nickel.

(5) Age hardenable and martensitic stainless steels whose compositions fall into the limits described in (3) above, except that they may have chromium up to 20%, aluminum up to 2.5%, titanium up to 1.5%, copper up to 4.0%, and columbium plus tantalum up to 0.5%.

In all cases, the core piece mechanical properties should exceed the following:

130 ksi ultimate tensile strength 80 ksi yield strength
5% tensile elongation
15% reduction in area
10 ft-lb (izod) impact strength.

Wear resistant exterior skin 19, which may have a thickness within 0.01 to 0.20 inch range, need not be uniform in thickness. This layer of hard wear-resistant material may, indeed, have islands of "inserts" whose thickness, composition, as well as shape, may be quite different than those of the remaining "skin." Materials suitable for the cone skin include:

(1) A composite mixture of particles of refractory hard compounds in a binding metal or alloy where the refractory hard compounds hava a micro-hardness of higher than 1,000 kg/mm$^2$ (50–100 g testing load), and a melting point of 1600° C. or higher in their commerically pure forms, and where the binding metal or alloy may be those based on iron, nickel, cobalt or copper.

Examples of such refractory hard compounds include carbides, oxides, nitrides and borides (or their mixtures) of elements Ti, W, Al, V, Zr, Cr, Mo, Ta, Nb, and Hf.

(2) Specialty tool steels, readily available in powder form, having large amounts of strong carbide formers such as Ti, V, Nb, Mo, W and Cr, and a carbon content higher than 2.0% by weight.

(3) Hardfacing alloys based on transition elements Fe, Ni or Co, with the following general chemistry ranges:

| | Cobalt Base | Nickel Base | Iron Base |
|---|---|---|---|
| Chromium | 25–30%* | 10–30% | 0–27% |
| Carbon | 0.1–3.5% | 0.4–3.0% | 0.1–4.0% |
| Tungsten | 4–13% | 0–5.0%. | — |
| Molybdenum | 0–5% | 0–17.0% | 0–11% |
| Boron | 0–2.5% | 0–5.0% | — |
| Iron | 0–3.0% | 3–29% | Balance |
| Nickel | 0–3.0% | Balance | 0–1.75% |
| Cobalt | Balance | 0–12% | — |
| Silicon | 0–2.0% | 0–4.5% | 0–1.5% |
| Manganese | 0–1.0% | 0–1.0% | 0–1.0% |

*percentage by weight (4) Wear-resistant intermetallic (Lave phase) materials based on cobalt or nickel as the primary constituent and having molybdenum (25–35%), chromium (8–18%), silicon (2–4%) and carbon 0.08% maximum.

Thrust-bearing 16 may be similar in composition to the exterior skin 19. In addition, when they are incorporated into the cone as inserts (pre-formed, separately processed cast, wrought or powder metal-produced shapes), they may be made of any metal or alloy having a hardness above 35 $R_c$. They may, in such cases, have a composite structure where part of the structure is a lubricating material such as molybdenum disulfide, tin, copper, silver, lead or their alloys, or graphite.

Cobalt-cemented Tungsten Carbide Inserts (TCI's), 17 in FIG. 1, are to be readily available cobalt-tungsten carbide compositions whose cobalt content usually is within the 5–18% range.

Bearing Alloy 15, if incorporated into the cone as a separately-manufactured insert, may either be a hardened or carburized or nitrided or borided steel or any one of a number of readily available commercial nonferrous bearing alloys, such as the bronzes. If the bearing is weld deposited, the material may still be a bronze. If, however, the bearing is integrally hot pressed in place from a previously applied powder, or if the insert is produced by any of the known powder metallurgy techniques, then it may also have a composite structure having dispersed within it a phase providing lubricating properties to the bearing.

Figure 4:
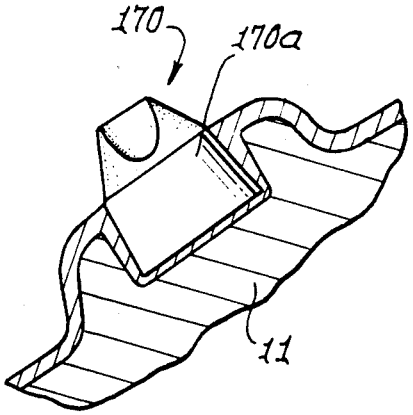
FIG. 4 is an enlarged section showing details of a wear resistant skin or layer in a body means receiving and mounting a tungsten carbide insert.

The cone configuration accords with the journal pin shape and is affected by the interaction of the cone with the other cones of the same bit. While configuration may vary somewhat, there are certain configurations associated with the cone sections identified as 11, 15, 16 17 and 19 which are unusually advantageous, and are listed as follows:

(1) Extension of the wear-resistant alloy skin layer 19 into the clearance between the walls of the blind end hole or recess in core piece 11, as well as the configuration of the insert 170 in FIG. 4 and having a non-parallel anchor portion 170*a*.

(2) Non-parallel sided inserts or TCI's, where the cross-sectional area at A-A' in FIG. 5*b* is smaller than that at the bottom of the TCI 370. Note anchor portion 370*a*. In addition, cross-sections on planes parallel to the bottom surface of the TCI need not be a circle, as customary, but may be any shape other than a circle; i.e., elliptical, irregular, polygonal, etc., and sides may not be equal in length.

(3) Thrust-bearing layer 16 may or may not be a single piece insert or a continuously applied powder metal layer. Indeed, this layer may be made up of several inserts 160–162 most likely to be circular in shape as indicated in FIG. 6*a*, or a combination of inserts and powdered metal layer 40 as exemplified in FIG. 6*b*.

EXAMPLES

A typical processing route involves the steps numbered 1, 3, 5, 6, 7, 10, 11, 12 and 15 in Table I. A low alloy steel composition is blended to form a powder mixture of composition suitable for the core. In one instance this mixture consituted an alloy having the following final analysis: 0.22% manganese, 0.23% molybdenum, 1.84% nickel, 0.27% carbon and remainder substantially iron. The powder was cold pressed to a preform and sintered at 2050° F. for one hour in a reducing furnace atmosphere. Carbide inserts were placed in the blind holes created in the preform and the exterior of the cone was painted with a slurry containing hardfacing metal powder, Stellite No. 1, making sure the slurry filled all clearance space between the carbide insert and the preform.

The slurry was prepared by mixing Stellite powder with 3% cellulose acetate powder and adding sufficient amount of acetone to develop the desired slurry fluidity. The Stellite No. 1 alloy powder had a nominal chemistry (in weight percent) of: 30% chromium, 2.5% carbon, 1% silicon, 12.5% tungsten, 1% maximum each of manganese and molybdenum, and 3% maximim each of iron and nickel, with remainder being substantially cobalt. Once applied, the outer skin formed on the core piece quickly dried at room temperature.

A thin layer of a thrust bearing alloy was similarly applied on surfaces identified by 16 in FIG. 1. The composition of this layer was the same as the exterior skin applied over the core piece. A radial bearing alloy tube segment was then fitted within the cylindrical section identified as 15 in FIG. 1. The AISI 1055 carbon steel tube having 0.1 inch wall thickness was fixed in place by placing it on a thin layer of slurry applied core piece alloy steel powder.

The preform asseambly, thus prepared, was dried in an oven at 100° F. for overnight, driving away all volatile constituents of the slurries. It was then induction heated to 2250° F. in less than 4 minutes and immersed in hot ceramic grain, which was also at 2250° F., within a cylindrical die. A pressure of 40 tons per square inch was applied, by way of a hydraulic press, onto the grain which transmitted the pressure, in various degrees, to the preform in all directions. The peak press pressure of 40 tsi was reached within 4–5 seconds and the peak pressure was maintained for less than 2 seconds and released. The die contents when emptied separated into grain and the consolidated conical cutter. Before the part had a chance to cool below 1600° F. it was transferred to a furnace operating at 1565° F., kept there for an hour and oil quenched. To prevent oxidation, the furnace atmosphere was adjusted to be a reducing atmosphere, e.g., cracked ammonia. The hardened part was then tempered for one hour at 1000° F. and air cooled to assure a tough and strong core.

A similarly processed tensile test bar when tensile tested exhibited 152 ksi ultimate tensile strength, 141 ksi yield strength, 12% elongation and 39% reduction of area. Another test bar which was processed in the same manner as above, except tempered at 450° F., exhibited 215 ksi ultimate tensile strength, 185 ksi yield strength, 7% elongation and 21% reduction of area. Thus, one may easily develop a desired set of mechanical properties in the consolidated core piece by tempering at a selected temperature.

In another example, powder slurry for the wear resistant exterior skin and the thrust bearing surface was prepared using a 1.5% by weight mixute of cellulose acetate with Stellite alloy No. 1 powder. This preform was dried at 250° F. for two hours instead of 100° F. for overnight and the remaining processing steps were identical to the above example. No visible differences were detected between the two parts produced by the two experiments.

In yet another example, radial bearing alloy was affixed to the interior wall of the core through the use of a nickel powder slurry similarly prepared as above. Once again the bond between the raidal bearing alloy and the core piece was extremely strong as determined by separately conducted bonding experiments.

OTHER PERTINENT INFORMATION

The term "composite" is used both in the microstructural sense or from an engineering sense, whichever is more appropriate. Thus, a material made up of discrete fine phase(s) dispersed within another phase is considered a composite of phases, while a structure made up of discrete, relatively large regions joined or assembled by some means, together is also considered a "composite." An alloy layer composed of a mixture of carbide particles in cobalt, would micro-structurally be a composite layer, while a cone cutter composed of various distinct layers, TCI's and other inserts, would be a composite part as well.

The term "green" in Table I, line 2, refers to a state where the powder metal part is not yet fully densified, but has sufficient strength to be handled without chipping or breakage. Sintering (the same table, line 3) is a process by which powdered (or otherwise) material is put in intimate contact and heated to cause a metallurgical bond between them.

This invention introduces, for the first time, the following novel features to a TCI drill bit cone:

(1) A "high temperature—short heating cycle" means of consolidation of a composite cone into a nearly finished product, saving substantial labor time and allowing the use of multiple materials tailored to meet localized demands on their properties.

(2) Various material layers are applied at or near room temperature, thus eliminating damage that would otherwise be occurring if a thermally-activated process was used.

(3) Unlike hot isostatic pressing (HIP) inside an autoclave pressurized by a gas, the hot pressing, as described herein, requires only a short time at high consolidation temperatures. This is partially due to the fact that rapid heating techniques most particularly usable in hot pressing, may not be suitable for heating inside an autoclave. This is a major advantage for the hot pressing process, whereby bonding of discrete particles takes place quickly (few minutes) without unwanted diffusion reactions. Thus, consolidation of a composite part, such as the conical cutter, is accomplished without any side effects, whereas in HIP, processing cycle takes up to 20 . . . sometimes 30 hours, mostly at high temperatures. Diffusion of such elements as carbon from the carbides, for example, then creates metallurgical problems of structural integrity. In the absence of such fears, as in the present method, the conical cutters have superior properties and superior field performance, and furthermore no diffusion barrier layer between the carbides and the cone material would be necessary.

(4) The use of non-parallel sided inserts.

(5) The use of a hard wear-resistant exterior layer, for example painted on cold, the same hard layer surrounding and locking the TCI in place after hot consolidation. The latter feature greatly simplifies the method of application of the exterior layer.

(6) Provision of lubricious inserts or insert, plus powder metal layers providing the thrust-bearing surface layer.

(7) Elimination of lengthy surface hardening processes such as carburizing.

(8) Vastly increased freedom of selection of materials.

(9) Increased freedom to extend the TCI's further outward for more aggressive cutting of the rock.

Figure 2:
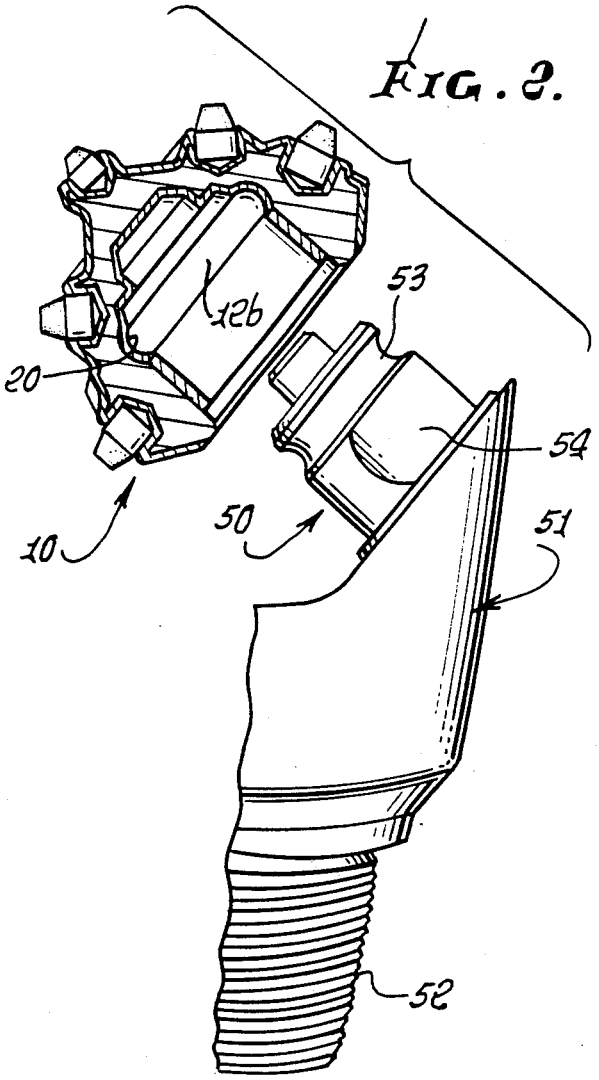
FIG. 2 is a perspective view showing components of a three-cone rotary bit.

FIG. 2 shows the conical bit cutter 10 of the invention applied to the journal pin 50 on a bit body 51, having a threaded stem 52. Pin 50 also provides a ball bearing race 53 adapted to register with race surface 20 about zone **12*b*, and journal bearing 54 adapted to mount layer 15** as described.

Figure 7A:
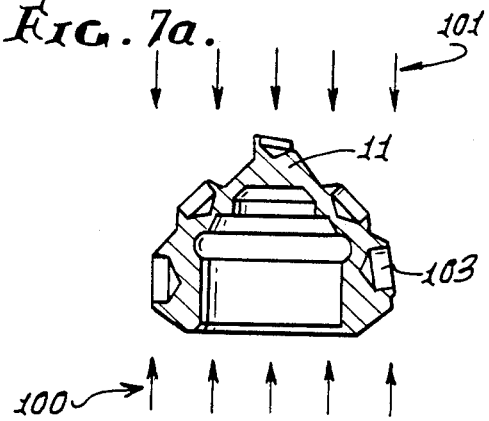
Figure 7B:
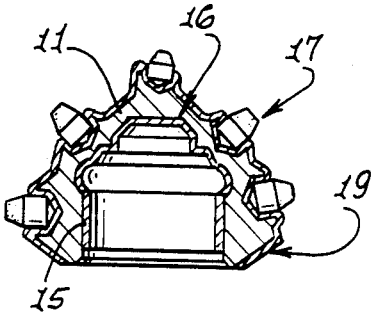
Figure 7C:
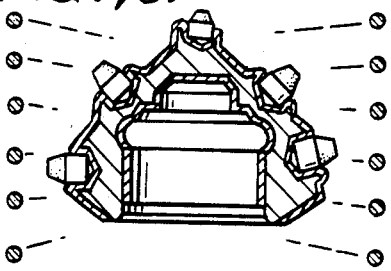

Step 3 of the process as listed in Table I is for example shown in FIG. 7*a*, the arrows 100 and 101 indicating isostatic pressurization of both interior and exterior surfaces of the core piece 11. Pressure application is effected for example by the use of rubber molds or ceramic granules packed about the core, and pressurized. Blind holes are shown at 103. Steps 5–10 of the Table I process are indicated in FIG. 7*b*. Step 11 of the process is exemplified by the induction heating step of FIG. 7*c*.

Figure 7D:
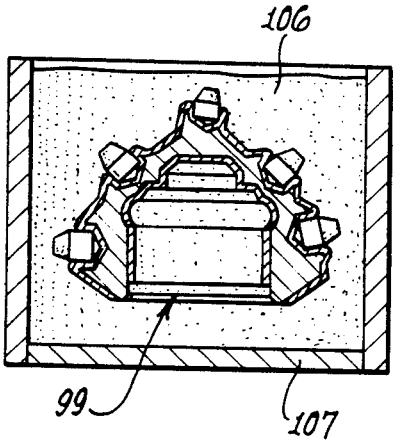
Figure 7E:
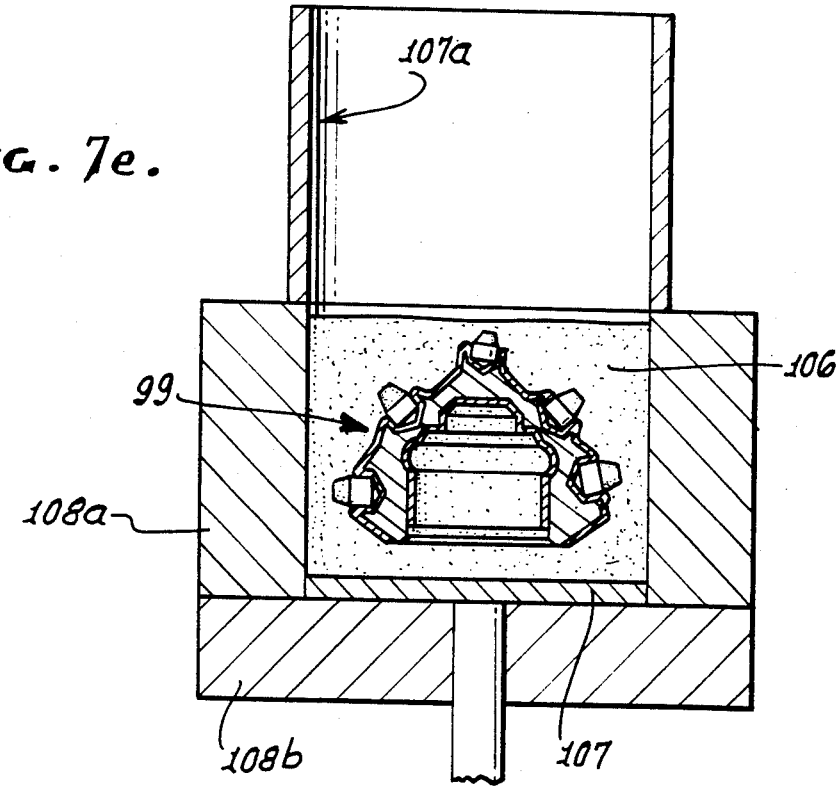
Figure 7G:
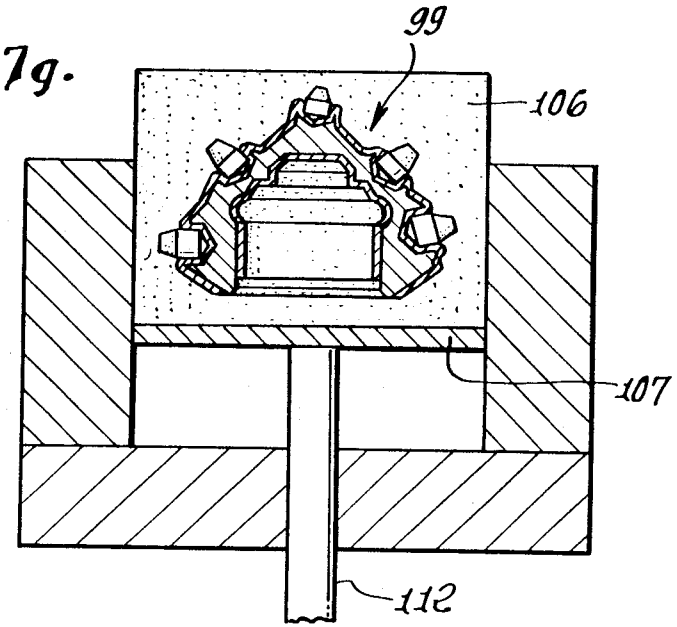
Figure 7H:
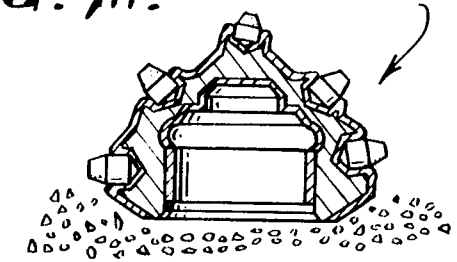
Figure 7F:
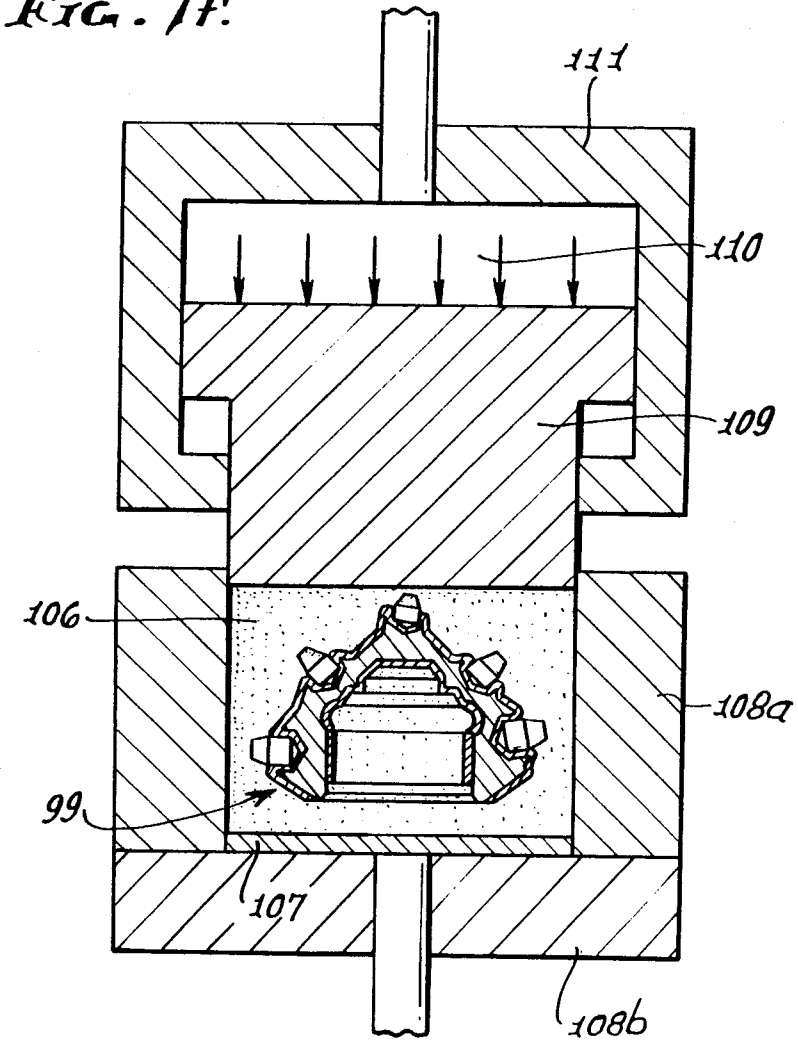

In FIG. 7*d*, the hot part (cone, as in FIG. 1) is indicated at 99 as embedded in hot ceramic grain 106, in shuttle die 107. The latter is then introduced into a press die 108 (see FIG. 7*e*), and the outer wall **107*a* of the shuttle die is upwardly removed. Die 108 has cylindrical wall 108*a* and bottom wall 108*b***. FIG. 7*f* is like FIG. 7*e*, but shows a plunger 109 applying force to the grain 106, in response to fluid pressure application at 110 to the plunger via actuator cylinder 111. This corresponds to step 12 of the Table I process. In FIG. *7g* the part 99 and grain 106 are upwardly ejected by a second plunger 112 elevating the bottom wall 107. In FIG. *7g*, the grain is removed from the part 106 and is recycled to step *7d*. The consolidated part including its component may then be finished, as by grit blasting, finish machining and grinding, and inspected. See step 15 of Table I.

REFERENCES

1. R. K. Sorensen and A. T. Rallis, "Journal and Pilot Bearings with Alternating Surface Areas of Wear-Resistant and Anti-Galling Materials," U.S. Pat. No. 3,984,158 (Oct. 5, 1976).
2. H. W. Murdoch, "Drill Bit," U.S. Pat. No. 4,074,922 (Feb. 21, 1978).
3. T. H. May, "Drill Bit Bearings," U.S. Pat. No. 3,721,307 (Mar. 20, 1971).
4. J. R. Whanger, "Journal Bearing with Alternating Surface Areas of Wear-Resistant and Anti-Galling Materials," U.S. Pat. No. 3,235,316 (Feb. 15, 1966).
5. J. R. Quinlan, "Aluminum Bronze Bearing," U.S. Pat. No. 3,995,917 (Dec. 7, 1976).
6. Hans B. Van Nederveen, Bosch en Duin and Martin B. Verburgh, "Drill Bit," U.S. Pat No. 4,365,679 (Dec. 28, 1982).

I claim:

1. A roller bit cutter, comprising, in combination:

(a) a tough, metallic generally conical and fracture resistant core having a hollow interior, the core defining an axis, (b) an annular metallic radial bearing layer carried by said core at the interior thereof to support the core for rotation, said bearing layer extending about said axis, (c) an impact and wear resistant metallic inner layer on the core, at the interior thereof, to provide an axial thrust bearing, and (d) hard metallic inserts having anchor portions carried by the core and partly embedded therein the inserts protruding outwardly at the exterior of the core to define cutters, at least some of the inserts spaced about said axis, (e) and a wear resistant outer metallic layer on the exterior of said core, (f) said core defining multiple recesses reciving said insert anchor portions, said outer metallic layer extending into said recesses and between the core and said insert anchor portions, (g) said outer layer consolidated under pressure in situ to look to and about the anchor portions of the inserts in said recesses, the insert anchor portions tapered in directions extending toward the exterior of the recesses, and the outer layer engaging said tapered anchor portions to have taper corresponding to that of said insert anchor portions, (h) said core consisting of consolidated ferrous powder metal steel having the following composition, with percentages being by weight:

| | |
|---|---|
| iron | 79 to 98% |
| copper | 0 to 20% |
| carbon | 0.4 to 1.0% |
| nickel | 0 to 4.0% |
| molybdenum | 25 to 35% |
| chromium | 8 to 18% |
| silicon | 2 to 4% |
| carbon | 0 to 0.08%. |

(i) said outer layer consisting of a composite mixture of refractory particles in a binder metal.

2. The combination of claim 1 wherein said inserts consist essentially of tungsten carbide.

3. The combination of claim 1 wherein said core is generally concial and has a tip portion, one of said recesses and one insert located at the cone tip portion.

4. The combination of one of claims 1-2 wherein at least one of said layers consists essentially of consolidated powder metal.

5. The combination of one of claims 1-3 wherein at least two of said layers consist of consolidated powder metal.

6. The combination of one of claims 1-3 wherein said bearing layer and inner layer also consist of consolidated powder metal.

7. The combination of claim 3 wherein the insert anchor portions have non-symmetrically flared ends, and said outer layer has flared portions compressively engaging said insert flared ends, in said recesses.

8. The combination of claim 3 or 7 wherein the core has mechanical properties in excess of the following lower limits;

130 ksi ultimate tensile strength
80 ksi yeild strength
5% tensile elongation
15% reduction in area
10 ft-lb (izod) impact strength.

9. The combination of claim 1 wherein said refractory particles have micro hardness in excess of 1,000 kg/mm$^2$, and a melting point in excess of 1,600° C.

10. The combination of claim 1 wherein said refractory particles are selected from the group consisting of Ti, W, Al, V, Zr, Cr, Mo, Ta, Nb, Hf, and carbides, oxides, nitrides and borides thereof.

11. The combination of claim 1 wherein said inner layer consists of tool steel initially of powder form.

12. The combination of claim 1 wherein said inner layer consists of a hardfacing alloy having a composition selected from one of the following three columnar groups:

| | Cobalt Base | Nickel Base | Iron Base |
|---|---|---|---|
| Chromium | 25-30%* | 10-30% | 0-27% |
| Carbon | 0.1-3.5% | 0.4-3.0% | 0.1-4.0% |
| Tungsten | 4-13 | 0-5.0% | — |
| Molybdenum | 0-5% | 0-17.0% | 0-11% |
| Boron | 0-2.5% | 0-5.0% | — |
| Iron | 0-3.0% | 3-29% | Balance |
| Nickel | 0-3.0% | Balance | 0-1.75% |
| Cobalt | Balance | 0-12% | — |
| Silicon | 0-2.0% | 0-4.5% | 0-1.5% |
| Manganese | 0-1.0% | 0-1.0% | 0-1.0% |

*percentage by weight

13. The combination of claim 1 wherein said inner layer consists of wear resistant, intermetallic Laves phase, materials based on a primary constitutent selected from the group consisting of cobalt and nickel, and having the following alloying elements, with indicated weight percents:

14. The combination of claim 1 including mounting structure on which said core and bearing layer are carried for rotation in a drilling operation.

15. The combination of claim 1 wherein said anchor portions are flared toward the exterior of the core.

16. The method of producing a roller bit cutter, that includes the steps:

(a) providing a tough, metallic generally conical and fracture resistant core having a hollow interior, the core defining an axis, (b) providing an annular metallic radial bearing layer carried by said core at the interior thereof to support the core for rotation, said bearing layer extending about said axis, (c) providing an impact and wear resistant metallic inner layer on the core, at the interior thereof, to provide an axial thrust bearing, (d) providing hard metallic inserts having anchor portion carried by the core and partly embedded therein, the inserts protruding outwardly at the exterior of the core to define cutters, at least some of the inserts spaced about said axis, (e) providing a wear resistant outer metallic layer on the exterior of said core, (f) providing said core with multiple recesses to receive said outer metallic layer and to receive said insert anchor portions of be surrounded by said metallic layer in said recesses, (g) said outer layer consisting of a composite mixture of refractory particles in a binder metal, and including the step of consolidating said outer layer under pressure to lock to said anchor portions, said pressure transmitted to the inserts and to the outer layer, (h) said core consisting of consolidated ferrous powder metal steel having the following composition, with percentages being by weight:

| | |
|---|---|
| iron | 79 to 98% |
| copper | 0 to 20% |
| carbon | 0.4 to 1.0% |

-continued

| | |
|---|---|
| nickel | 0 to 4.0%. |

17. The method of claim 16 wherein said inserts consist essentially of tungsten carbide.

18. The method of claim 16 wherein said pressure is transmitted simultaneously to the inserts and the outer layer.

19. The method of one of claims 16–18 wherein at least one of said layers consists essentially of consolidated powder metal.

20. The method of one of claims 16–18 wherein at least two of said layers consist of consolidated powder metal, and said pressure is transmitted to both layers.

21. The method of one of claims 16–18 wherein said bearing layer and inner layer consist of consolidated powder metal, and said pressure is transmitted to all three layers.

22. The method of claim 18 wherein the insert anchor portions are provided with non-symmetrically flared ends, and said outer layer is provided with flared portions compressively engaging said insert flared ends, in said recesses, said pressure transmitted via the insert flared ends to the outer layer in said recesses.

23. The method of claims 18 or 22 wherein the core has mechanical properties in excess of the following lower limits:

130 ksi ultimate tensile strength
80 ksi yield strength
5% tensile elongation
15% reduction in area
10 ft-lb (izod) impact strenth.

24. The method of claim 16 wherein said outer layer consists of a composite mixure of refractory particles in a binder metal.

25. The method of claim 24 wherein said refractory particles have micro hardness in excess of 1,000 kf/mm$^2$, and a melting point in excess of 1,600° C.

26. The method of claim 24 wherein said refractory particles are selected from the group consisting of Ti, W, Al, V, Zr, Cr, Mo, Ta, Nb, Hf, and carbides, oxides, nitrides and borides thereof.

27. The method of claim 16 wherein said outer layer consists of tool steel initially in powder form.

* * * * *